US005612510A

United States Patent [19]

Hildreth

[11] Patent Number: 5,612,510

[45] Date of Patent: Mar. 18, 1997

[54] HIGH-VOLTAGE AUTOMOBILE AND APPLIANCE CABLE

[75] Inventor: Nelson Hildreth, Colchester, Vt.

[73] Assignee: Champlain Cable Corporation, Colchester, Vt.

[21] Appl. No.: 320,721

[22] Filed: Oct. 11, 1994

[51] Int. Cl.[6] ..... H01B 7/02

[52] U.S. Cl. ..... 174/120 SC; 174/120 SR

[58] Field of Search ..... 174/120 SC, 120 R, 174/120 SR, 120 AR, 102 SC, 110 N, 110 AR, 110 SR, 110 PM; 338/214

[56] References Cited

U.S. PATENT DOCUMENTS

| | | | |
|---|---|---|---|
| 3,096,210 | 7/1963 | Boonstra | 174/120 SC |
| 3,749,817 | 7/1973 | Shiga et al. | 174/102 SC |
| 3,935,042 | 1/1976 | Wahl | 174/120 SC |
| 4,317,001 | 2/1982 | Silver et al. | 174/102 SC |
| 4,360,706 | 11/1982 | Lanfranconi et al. | 174/105 SC |
| 4,469,539 | 9/1984 | Wade et al. | 174/120 SC |
| 5,095,175 | 3/1992 | Yoshida et al. | 174/120 SC |

FOREIGN PATENT DOCUMENTS

| | | | |
|---|---|---|---|
| 23908 | 8/1975 | Japan | 174/120 SC |
| 15809 | 4/1980 | Japan | 174/120 SC |
| 55715 | 3/1991 | Japan | 174/102 SC |

*Primary Examiner*—Kristine L. Kincaid
*Assistant Examiner*—Marc D. Machtinger
*Attorney, Agent, or Firm*—Salzman & Levy

[57] ABSTRACT

The present invention features a high-voltage, high-temperature cable article for use with electric motors, coils, transformers, generators and power supplies. The cable article has a conductive core member overlaid with an intermediate, semiconductive layer and an outer, insulative jacket layer. The intermediate, semiconductive layer can be a carbon-impregnated polymer such as a carbon-impregnated polyethylene; a carbon-impregnated, ethylene-propylene-diene terpolymer (EPDM); semiconductive nylon tape; semiconductive PTFE (polytetrafluoroethylene) tape; semiconductive fabric tape; or a semiconductive extruded fluorocarbon. The temperature rating of the cable article is at least approximately 150° C.; the voltage rating can be in a range of approximately between 1,000 to 15,000 volts. The wall thickness of the semiconductive layer can range from approximately 2 to 20 mils. The outer, insulative jacket layer can be a cross-linked polyolefin, an elastomeric or a thermoplastic elastomer material. The conductive core can be solid or stranded wire.

20 Claims, 1 Drawing Sheet

HIGH-VOLTAGE AUTOMOBILE AND APPLIANCE CABLE

FIELD OF THE INVENTION

The present invention pertains to a motor lead and appliance cable article and, more particularly, to a wire-and-cable product having a high-voltage rating of approximately 7,500 volts at an operative temperature of approximately 150° C., or greater.

BACKGROUND OF THE INVENTION

The current standard, UL-voltage-rated cable is 600 volts. A voltage rating of 7,500 volts is not uncommon for industrial, utility or outside applications. However, when the insulation of the cable must have sufficient flame retardancy, or when it contains fillers and/or stabilizers for high-temperature operation (≧150° C.), high voltage capability is difficult to achieve. In addition, the wall thickness of present high-voltage motor lead wire (UL-style 3499) is 0.156 inches.

The present invention can provide a voltage rating that is greater than 1,000 volts, with the wire having a small wall thickness, one of approximately between 0.045 to 0.090 inches. Such results are achieved by introducing a semiconductive layer between the insulation and the wire core conductor. This cable article is most useful for electric motors, but this invention can also be applied to coils, transformers, generators and power supplies.

The semiconductive layer of the inventive cable has a nominal resistance of approximately 5,000 ohms. Applicant discovered that semiconductive materials with resistances of 1,000–5,000 ohms per square worked very well, but there were also successful test results with semiconductive layers over a wide range of resistances. The semiconductive layer can be extruded or tape-wrapped about the conductive core. For electric motors, the cable size is in an approximate range of between 8 AWG and 4/0 AWG. The semiconductive layer can comprise a carbon-impregnated polymer such as a carbon-impregnated polyethylene; a carbon-impregnated woven (or non-woven) fibrous-tape, or an ethylene-propylene-diene terpolymer (EPDM).

SUMMARY OF THE INVENTION

In accordance with the present invention, there is provided a high-voltage, high-temperature cable article for use with electric motors and appliances. The cable article comprises a conductive core member overlaid with an intermediate, semiconductive layer and an outer, insulative jacket layer. The intermediate, semiconductive layer can comprise a carbon-impregnated polymer such as a carbon-impregnated polyethylene; a carbon-impregnated, ethylene-propylene-diene terpolymer (EPDM); semiconductive nylon tape; semiconductive PTFE (polytetrafluoroethylene) tape; semiconductive fabric tape; or a semiconductive extruded fluorocarbon. The temperature rating of the cable article is at least approximately 150° C.; the voltage rating can be in a range of approximately between 1,000 to 15,000 volts. The wall thickness of the semiconductive layer can range from approximately 2 to 20 mils. The outer, insulative jacket layer can comprise a cross-linked polyolefin, an elastomeric or a rubber material, or a thermoplastic elastomer. The conductive core can comprise solid or stranded wire.

It is an object of this invention to provide an improved high-voltage cable article.

It is yet another object of the invention to provide a high-voltage cable article that has a semiconductive layer comprising a carbon-impregnated polymer.

It is another object of the invention to provide a high-voltage cable article that is operative in a voltage range of 1,000 to 15,000 volts and at a temperature in the range of at least 150° C.

BRIEF DESCRIPTION OF THE DRAWINGS

A complete understanding of the present invention may be obtained by reference to the accompanying drawings, when considered in conjunction with the subsequent detailed description, in which.

For the sake of brevity and clarity, like elements and components will bear the same designations throughout the FIGURES.

DESCRIPTION OF THE PREFERRED EMBODIMENT

Generally speaking, the invention features a high-voltage, high-temperature cable article for use with electric motors, coils, transformers, generators and power supplies. The cable article comprises a conductive core member overlaid with an intermediate, semiconductive layer and an outer, insulative jacket layer.

Figure 1:
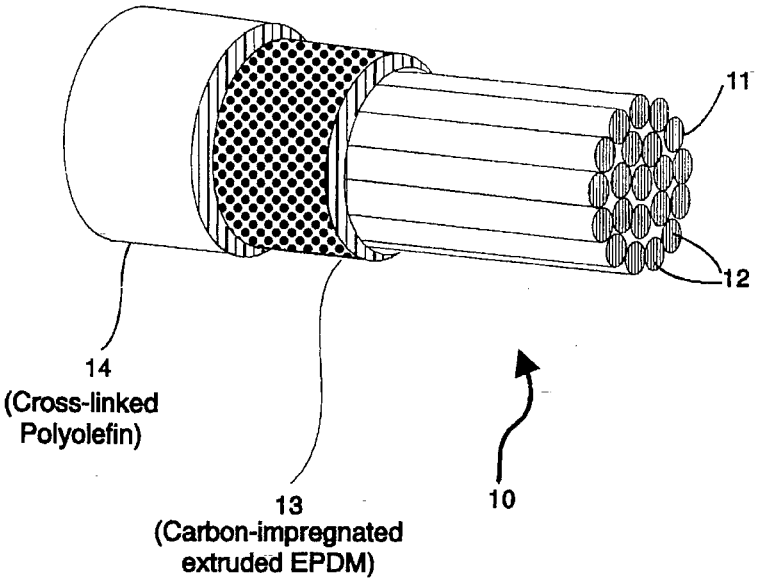
FIG. 1 is a perspective view of the cable article of this invention.

Now referring to FIG. 1, a cable article 10 of this invention is shown. The cable article comprises a conductive core member 11 comprising several strands of conductive wire 12. The core member 11 is overlaid with an intermediate, semiconductive layer 13 and an outer, insulative jacket layer 14. The intermediate, semiconductive layer 13 can comprise a carbon-impregnated polymer such as a carbon-impregnated polyethylene; a carbon-impregnated, ethylene-propylene-diene terpolymer (EPDM); semiconductive nylon tape; semiconductive PTFE (polytetrafluoroethylene) tape; semiconductive fabric tape; or a semiconductive extruded fluorocarbon.

The temperature rating of the cable article 10 is at least approximately 150° C.; the voltage rating can be in a range of approximately between 1,000 to 15,000 volts. The wall thickness of the semiconductive layer 13 can range from approximately 2 to 20 mils. The outer, insulative jacket layer 14 can comprise a cross-linked polyolefin, an elastomeric (such as EPDM or silicon rubber) or a thermoplastic elastomer.

Figure 2:
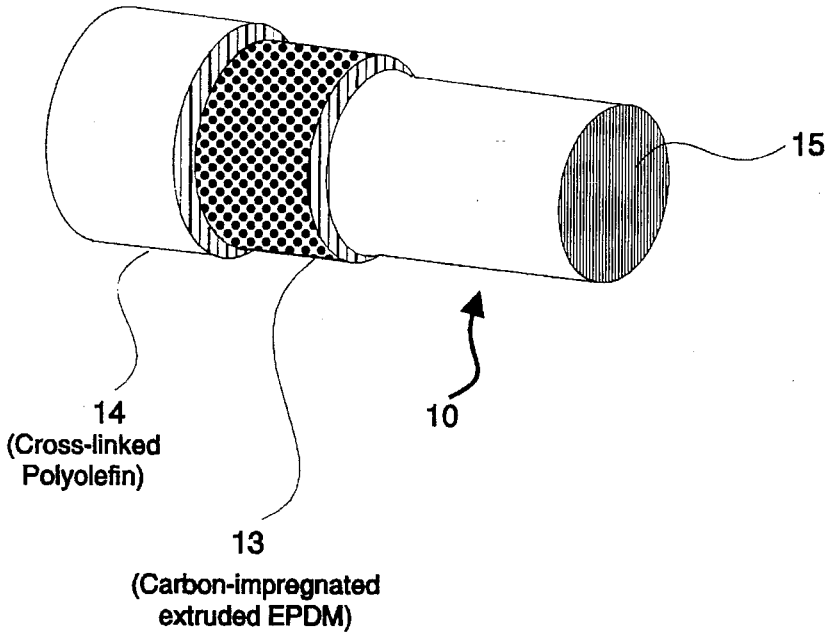
FIG. 2 is an alternate embodiment of the cable article illustrated in FIG. 1.

Referring to FIG. 2, the cable article 10 of FIG. 1 is shown, modified. In place of the stranded wire, this modification comprises a solid, one-piece conductive core member 15.

Several cable articles have been fabricated utilizing this invention. These are described by the data presented in the following tables.

TABLE 1

| | |
|---|---|
| Style | 3575 |
| Rating | 150° C.; 7,500 volts AC |
| Conductive Core | No. 8-4/0 AWG, solid or stranded |
| Intermediate Layer (Layer 13) | Carbon-filled polyethylene |

TABLE 1-continued

| | | |
|---|---|---|
| Insulation Layer (Layer 14) | Conductor Size | Minimum Insulation thickness |
| | 8 AWG | 45 mils |
| | 7 - 2 AWG | 60 mils |
| | 1 - 4/0 AWG | 80 mils |
| Standard | test reference: Standard UL 1581 and Standard UL 814 for Gas-Tube-Sign and Ignition Cable | |
| Insulation Layer (Layer 14) | Conductor Size | Spark test |
| | 8 AWG | 8,000 volts |
| | 7 - 2 AWG | 10,000 volts |
| | 1 - 4/0 AWG | 12,000 volts |

TABLE 2

| Rating | 150° C.; 7,500 volts 8 AWG* | 4/0 AWG** |
|---|---|---|
| Wall Thickness (mils)[1] | 45–50 | 80–90 |
| High Voltage Strength (360 hrs. @ 15,000 volts AC) | Pass | Pass |
| Dielectric Strength (25,000 volts for 5 minutes) | | |
| Unaged | Pass | Pass |
| Aged 7 days @ 180° C. @ 11,250 volts AC[2] | Pass | Pass |

*Semiconductive layer (layer 13) - carbon-impregnated polyethylene tape.
**Semiconductive layer (layer 13) - carbon-impregnated, extruded EPDM
[1]Insulation layer (layer 14) - cross-linked polyolefin
[2]Test reference: UL Standards 1581 and 814 for Gas-Tube-Sign and Ignition Cable Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A cable article having a high voltage rating of approximately 7,500 volts and at an operative temperature of at least approximately 150° C., comprising:

a conductive core member;

an intermediate, semiconductive layer overlaying said conductive core member, said semiconductive layer comprising a carbon-impregnated nylon tape having a wall thickness in the approximate range of between 2 and 20 mils; and an outer, insulative jacket layer overlaying said intermediate, semiconductive layer comprising a cross-linked polyolefin.

2. The cable article in accordance with claim 1, comprising a voltage rating in a range of approximately between 1,000 to 15,000 volts.

3. The cable article in accordance with claim 1, wherein said outer, insulative jacket layer comprises a polyolefin rubber, such as EPDM.

4. The cable article in accordance with claim 1, wherein said outer, insulative jacket layer comprises silicon rubber.

5. The cable article in accordance with claim 1, wherein said outer, insulative jacket layer comprises a thermoplastic elastomer material.

6. The cable article in accordance with claim 1, wherein said conductive core member comprises stranded wire.

7. The cable article in accordance with claim 1, wherein said conductive core member comprises a solid conductor.

8. A cable article having a high voltage rating in an approximate range of 1,000 to 15,000 volts and at an operative temperature of at least approximately 150° C., comprising:

a conductive core member;

an intermediate, semiconductive layer overlaying said conductive core member and having a wall thickness in an approximate range of 2 to 20 mils, said semiconductive layer comprising a carbon-impregnated nylon tape; and an outer, insulative jacket layer overlaying said intermediate, semiconductive layer comprising a cross-linked polyolefin.

9. The cable article in accordance with claim 8, wherein said outer, insulative jacket layer comprises a polyolefin elastomer, such as EPDM.

10. The cable article in accordance with claim 8, wherein said outer, insulative jacket layer comprises silicon rubber.

11. The cable article in accordance with claim 8, wherein said outer, insulative jacket layer comprises a thermoplastic elastomer material.

12. The cable article in accordance with claim 8, wherein said outer, insulative jacket layer comprises a rubber material.

13. The cable article in accordance with claim 8, wherein said conductive core member comprises stranded wire.

14. The cable article in accordance with claim 8, wherein said conductive core member comprises a solid conductor.

15. A cable article having a high voltage rating in an approximate range of 1,000 to 15,000 volts and at an operative temperature of at least approximately 150° C., comprising:

a conductive core member;

an intermediate, semiconductive layer overlaying said conductive core member and having a wall thickness in an approximate range of 2 to 20 mils, said semiconductive layer comprising a carbon-impregnated nylon polymer; and an outer, insulative jacket layer overlaying said intermediate, semiconductive layer comprising a cross-linked polyolefin, and whereby said cable article meets UL standards 1581 and 814.

16. A cable article having a high voltage rating in an approximate range of 1,000 to 15,000 volts and at an operative temperature of at least approximately 150° C., comprising:

a conductive core member;

an intermediate, semiconductive layer overlaying said conductive core member and having a wall thickness in an approximate range of 2 to 20 mils, said semiconductive layer comprising semiconductive nylon tape; and an outer, insulative jacket layer overlaying said intermediate, semiconductive layer.

17. A cable article having a high voltage rating in an approximate range of 1,000 to 15,000 volts and at an operative temperature of at least approximately 150° C., comprising:

a conductive core member;

an intermediate, semiconductive layer overlaying said conductive core member comprising a carbon-impregnated nylon tape; and an outer, insulative jacket layer comprising a cross-linked polyolefin with a wall thickness of less than 0.1 inch overlaying said intermediate, semiconductive layer.

18. The cable article in accordance with claim 17, wherein said outer, insulative jacket layer comprises a polyolefin rubber, such as EPDM.

19. The cable article in accordance with claim 17, wherein said outer, insulative jacket layer comprises silicon rubber.

20. The cable article in accordance with claim 17, wherein said outer, insulative jacket layer comprises a thermoplastic elastomer material.

* * * * *